United States Patent [19]

Lyons, Jr.

[11] Patent Number: 4,941,300

[45] Date of Patent: Jul. 17, 1990

[54] ROOFING MEMBRANE TO ROOF OPENING SEALING SYSTEM AND HATCHWAY EMPLOYING SAME

[76] Inventor: George Lyons, Jr., P.O. Box 892, 20 W. Middle Beach Rd., Madison, Conn. 06443

[21] Appl. No.: 334,192

[22] Filed: Apr. 5, 1989

[51] Int. Cl.[5] ..... E04D 13/14

[52] U.S. Cl. ..... 52/58; 52/72; 52/200; 52/395

[58] Field of Search ..... 52/58, 59, 60, 72, 200, 52/199, 395

[56] References Cited

U.S. PATENT DOCUMENTS

| | | | |
|---|---|---|---|
| 618,074 | 1/1899 | Dyer . | |
| 1,840,041 | 1/1932 | Kellogg . | |
| 1,875,640 | 9/1932 | Moore . | |
| 2,423,955 | 7/1947 | Widener . | |
| 2,851,973 | 9/1958 | Stark et al. . | |
| 3,065,572 | 11/1962 | Weingartner . | |
| 3,247,632 | 4/1966 | Bloxsom . | |
| 3,292,323 | 12/1966 | Hagan . | |
| 3,296,762 | 1/1967 | Thom | 52/395 |
| 3,399,500 | 9/1968 | Shapiro . | |
| 3,417,527 | 12/1968 | Kiekhaefer . | |
| 3,434,250 | 3/1969 | Kiekhaefer . | |
| 3,461,625 | 8/1969 | Sandow | 52/58 |
| 3,766,696 | 10/1973 | Totoonchie . | |
| 3,802,131 | 4/1974 | Resech . | |
| 3,838,544 | 10/1974 | Hindall . | |
| 3,901,613 | 8/1975 | Andersson . | |
| 4,112,632 | 9/1978 | Simpson . | |
| 4,409,767 | 10/1983 | Jentoft et al. . | |
| 4,462,190 | 7/1984 | Allen . | |
| 4,603,517 | 8/1986 | Lyons, Jr. . | |
| 4,781,008 | 11/1988 | Lyons, Jr. . | |

FOREIGN PATENT DOCUMENTS

| | | |
|---|---|---|
| 98982 | 8/1964 | Denmark . |
| 579431 | 7/1933 | Fed. Rep. of Germany . |
| 1509089 | 5/1969 | Fed. Rep. of Germany . |
| 2832658 | 2/1980 | Fed. Rep. of Germany . |
| 2951275 | 7/1981 | Fed. Rep. of Germany . |
| 908935 | 11/1945 | France . |
| 2449176 | 10/1980 | France . |
| 684055 | 3/1965 | Italy . |
| 833539 | 4/1960 | United Kingdom . |

*Primary Examiner*—Richard E. Chilcot, Jr.
*Attorney, Agent, or Firm*—DeLio & Associates

[57] ABSTRACT

A sealing system is shown for sealing between a waterproof roofing membrane and a curb around a roof opening, including a cap flashing for the curb, a top flange connected to the cap flashing and extending outwardly therefrom and a wall flange connected to the top flange which extends downwardly and forms a filler channel defined by the top flange, the wall flange and the curb. The roofing membrane is held in the filler channel by folding it over a longitudinal resilient filler material sized to fit closely within the filler channel. A plurality of spaced-apart tabs integral with the wall flange are bent into the filler channel beneath the filler material to securely hold the membrane therein without the necessity for any loose fasteners. A preassembled sealing system perimeter frame ready for mounting on an existing curb, a sealing system with an attached hatchway cover, and a complete hatchway with perimeter frame sealing system, cover, curb and associated flashing are also disclosed.

14 Claims, 2 Drawing Sheets

16
53
30
42
32
55
44
34
46
14
3
54
52
48
60
56
50
58
36
20
38
26
40
28
22
24

10
16
18
34
24
30
42
38
32
20
12
34
46
50
2
14
28
48
26
2

32
34
44
30
46
14
54
56
56
48
50
20
26

ROOFING MEMBRANE TO ROOF OPENING SEALING SYSTEM AND HATCHWAY EMPLOYING SAME

BACKGROUND OF THE INVENTION

1. Field of the Invention

This invention relates to a sealing system for producing a waterproof seal between a waterproof roofing membrane and the curb surrounding a roof opening. It also relates to roof hatchways employing such a sealing system.

2. Related Art

Modern waterproof roofing membranes are extremely effective in providing a long lasting durable waterproof roof. To apply a roof employing such membranes, rolls of the roofing membrane sheet material are unrolled to cover the surface of a roof to be sealed, and then cut to fit. Adjacent pieces of the membrane are sealed to each other with heat or adhesive to form a perfectly waterproof cover for the roof. Problems are seldom encountered with such roofing membranes in the flat and unobstructed areas of the roof. However, when it is necessary to provide an opening in the roof, such as is required for a scuttle, access hatch, automatic fire vent or skylight, great care must be taken to ensure that the roofing membrane is tightly sealed to the curb wall surrounding the roof opening.

In the unobstructed areas of the roof, adjacent pieces of the roofing membrane can easily be bonded together in flat, wrinkle-free seams. Because these portions of the roof are flat or only moderately inclined, the membrane and seams are fully supported by the underlying roof and by the force of gravity which tends to hold the membrane in position.

However, at the curb surrounding a roof opening, the roofing membrane must be turned around corners and up along the faces of the curb wall to maintain the waterproof seal. On these surfaces, the roofing membrane is not supported and the force of gravity constantly pulls on the roofing membrane, occasionally causing it to slip out of position, ultimately causing leaks. Thus it is necessary to mechanically secure the turned-up edge of the roofing membrane near the top of the curb wall to provide support. This support is also important during installation of the roofing membrane when it is necessary to hold portions of the membrane temporarily in position before final sealing of the membrane seams.

Such mechanical support is presently accomplished by nailing the membrane roofing material at the top of the curb. However, this punctures the membrane material and is often the source of leaks. Also, on the harsh exposed environment of the roof, conventional nails are prone to rusting. Thus, specialized corrosion resistant fasteners are required which are often supplied with the flashing which accompanies a roof hatch. Unfortunately, these loose fasteners are easily lost during shipment and are difficult to distinguish from conventional fasteners, resulting in the substitution of non-corrosion resistant fasteners which corrode and fail.

Accordingly, one object of the present invention is to provide a waterproof sealing system between a roofing membrane and a curb which does not employ loose fasteners. Another object of the invention is to provide a sealing system wherein the spacing of the fasteners is even, providing good support for the membrane along the entire upper edge of the curb. Yet another object of the invention is to provide a reliable, inexpensive and easily installed support for the roofing membrane at the upper edge of the curb. A further object of the invention is to provide a pre-manufactured sealing system of suitable size and shape to be positioned on an existing curb surrounding the perimeter of a roof opening. Still another object of the invention is to provide a roof hatchway integrated with a premanufactured sealing system, appropriate flashing and a curb suitable for positioning around a roof opening.

SUMMARY OF THE INVENTION

The above and other objects which will be apparent to those skilled in the art are achieved in the present invention which provides a sealing system for sealing between a roofing membrane and a curb around the roof opening comprising a cap flashing for the curb, a top flange connected to the cap flashing and extending outwardly from the cap flashing, and a wall flange connected to the top flange and extending downwardly therefrom whereby a filler channel is defined by the top flange, the wall flange and the curb. A longitudinal resilient filler material is sized to fit closely within the filler channel and to hold the roofing membrane therein with the roofing membrane being folded over the filler material. A plurality of spaced-apart tabs are formed integral with the wall flange. The tabs are inwardly bendable towards the curb thereby securely retaining the filler material and the folded roofing membrane within the filler channel.

Two principle embodiments of the invention are shown. In the first, the tabs are punched from the wall flange along a substantial portion of their perimeter, the remainder of the unpunched perimeter defining a bending portion of the tab. In the second, the tabs extend from a lower edge of the wall flange, the portion of the tab connected to the wall flange defining the bending portion of the tab. The sealing system is also shown as a pre-manufactured unit of suitable size and shape to be positioned on a curb, and may be manufactured in combination with a hatchway cover hinged to the sealing system to form a complete hatchway ready for installation.

BRIEF DESCRIPTION OF THE DRAWINGS

Practical embodiments of the invention are shown in the accompanying drawings wherein.

DETAILED DESCRIPTION OF THE INVENTION

Figures 1, 2, 3:
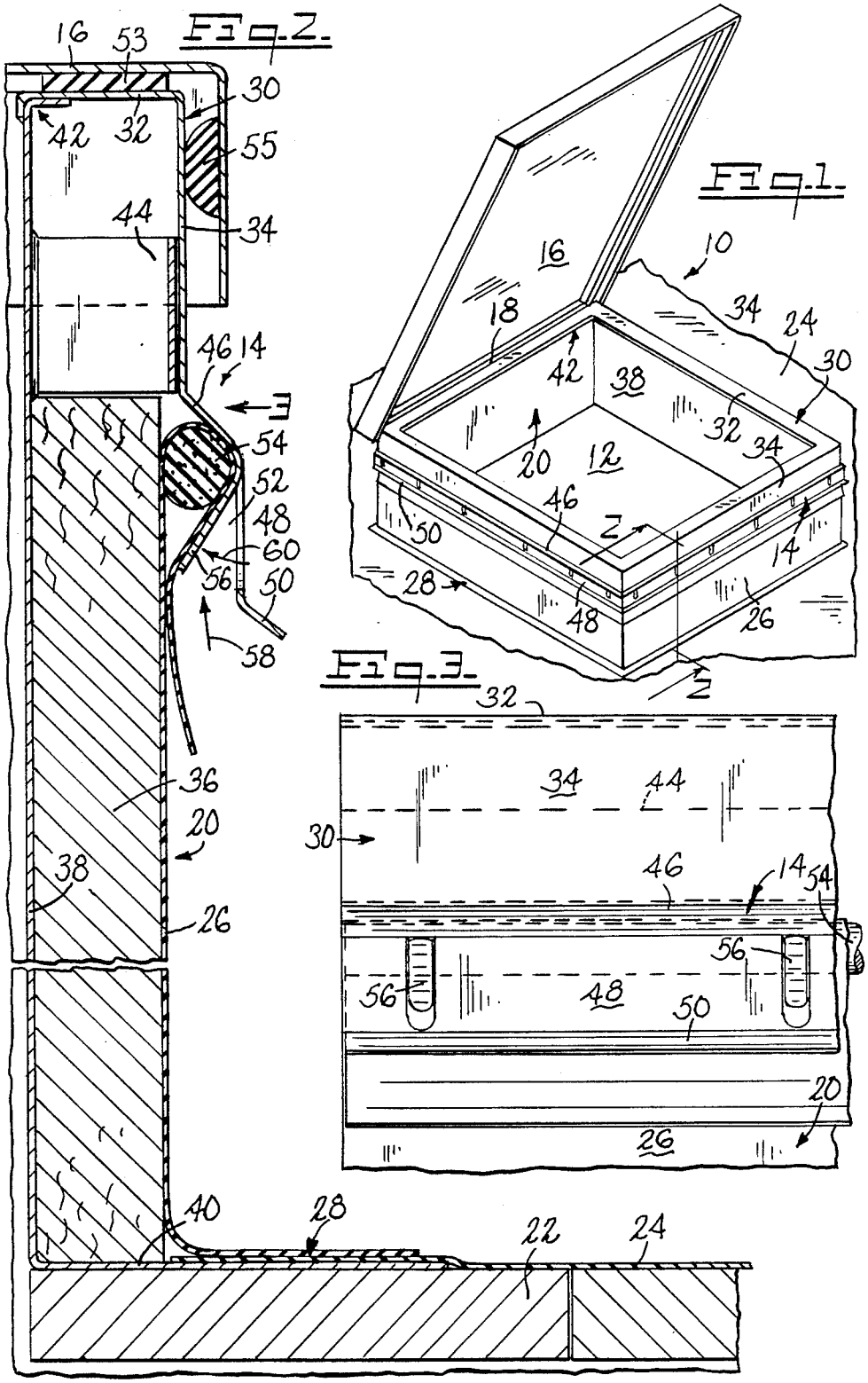
FIG. 1 is a perspective view of a hatchway for a roof opening including the sealing system of the invention.
FIG. 2 is a cross sectional view along the lines 2—2 of FIG. 1 except that the hatch cover is shown in this Figure in the closed position to show its relationship to the sealing system.
FIG. 3 is a front elevational view of a section of the sealing system of the present invention seen from the direction of arrow 3 in FIG. 2. In this Figure the hatch cover has been lifted again as in FIG. 1.

FIG. 1 shows a perspective view of a hatchway 10 for a roof opening 12 incorporating the sealing system 14 of the present invention. The hatchway 10 comprises a hatchway cover 16 conventionally hinged along a hinge line 18 to the sealing system 14.

The sealing system 14 is positioned on top of a curb 20 which surrounds the perimeter of the roof opening 12. The curb 20 may be a conventional wooden or metallic curb or it may be integrated with the sealing system as described herein and shown in FIG. 2. The curb 20 prevents snow and rain, which may accumulate on the roof, from entering the roof opening 12.

To seal the roof and the joints between the curb 20 and the roof 22, a roofing membrane 24 is laid on the upper surface of the roof and wraps up onto the exterior face of the curb wall 20. A single piece of the roofing membrane may wrap up from the roof onto the curb to form a continuous unbroken seal, or a separate piece 26 such as is shown in FIG. 2 may be applied to the curb on one or more sides and sealed (at 28) to the roofing membrane 24 which stops at the base of the curb.

Referring to FIG. 2, the sealing system includes an L-shaped cap flashing indicated generally at 30 which comprises a horizontal portion 32 and a vertical portion 34.

In the preferred embodiment shown in FIGS. 1–4, the sealing system 14 is integrated with a pre-manufactured curb formed from wood, foam or a composition board material 36 on its outer surface and a sheet metal inner surface 38. The inner surface 38 is bent 90° to form a base flashing 40 which may be adhesively sealed and nailed or screwed in a conventional manner to the roof 22. The outer surface 36 is preferably an insulating material. It must be compatible with the type of roofing membrane 26 being applied.

The inner surface of the curb 38 projects above the outer surface 36 and is attached at 42 to the horizontal portion 32 of the cap flashing 30. The inner surface 38 of the curb is also connected to the vertical portion 34 of the cap flashing by an inner support 44 which provides structural rigidity for the cap flashing and for the upper portion of the curb. It also provides a reinforced and convenient mounting position for hinges, latches etc., used in connection with the hatchway and cover 16.

The inner support 44 is also preferably formed of bent sheet stock and is welded to the inner portion 38 of the curb 20. Its position on top of the outer portion 36 of the curb provides great strength and support for the cap flashing 30 which must occasionally support the weight of a person climbing over the curb through the roof opening 12.

Also forming part of the sealing system 14 are the top flange 46, the wall flange 48 and the drip edge flange 50, all of which are preferably formed from the same sheet of metal as the cap flashing 30. The drip edge flange 50 acts in conjunction with the wall flange to direct rain away from the sealing system and the curb.

The cap flashing 30 is positioned on top of the curb 20 such that the top flange 46, which is connected to the lower edge of the cap flashing 30, extends outwardly from the cap flashing away from the curb. Thus, the wall flange 48, which is connected to the lower edge of the top flange and which extends downwardly therefrom, forms a filler channel 52 which is open at the bottom and which is defined at the top by the top flange, on one side by the wall flange 48 and on the other side by the curb 20.

The cap flashing 30 and the attached flanges 46, 48 and 50 are preferably formed out of a single sheet of aluminum, as is the base flashing 38 and the inner portion of the pre-manufactured curb 40. However, other sheet materials are suitable, including painted or other forms of corrosion resistant steel, and plastic or plastic coated materials provided that the materials are sufficiently sound structurally and are resistant to corrosion, temperature extremes and the solar radiation found on a roof.

A longitudinal resilient filler material 54 is provided which is sized to fit closely within the filler channel 52. The filler material 54 is preferably a cross-linked polyethylene which is extruded as a flexible cylindrical rod having a diameter slightly larger than the distance between the exterior face of the curb wall and the inner surface of the wall flange 48. A suitable material is commonly referred to as "backer bar". This material has the advantage of being relatively inexpensive and meets the additional requirement of being resistant to the temperature extremes encountered on the roof while retaining its elastomeric properties. Another suitable material is extruded plastic hot water pipe.

During installation, the membrane material 26 is brought up the exterior face of the curb 20 and folded over the filler material 54 which is then pushed up into the downwardly opening filler channel 52 where it is compressed slightly between the wall flange 48 and the curb 20. The resilient nature of the filler material 54 holds the membrane material 26 in the filler channel while the remaining portions of the roofing membrane are carefully positioned prior to final sealing.

FIG. 2 shows the hatchway cover 16 in the closed position (as compared to FIGS. 1 and 3 where it is open) to illustrate the manner in which it overlaps the cap flashing 30. This overlap prevents moisture from entering the roof opening 12 over the edge of the cap flashing 30. The seal is further improved by conventional gaskets 53, 55. made of an elastomeric material. These gaskets may be mounted either on the inner surface of the cover 16 or on the outer surface of the cap flashing 30.

Referring now to FIG. 3, it can be seen that the wall flange 48 includes a plurality of evenly spaced-apart tabs 56 which are integral with the wall flange 48. As shown in FIG. 3, the tabs 56 are punched on three sides from the wall flange 48 and are shaped in the form of fingers. The tabs 56 are left connected to the wall flange at their top, and the width of this unpunched portion of their perimeter controls the force required to bend the tab.

Figure 4:
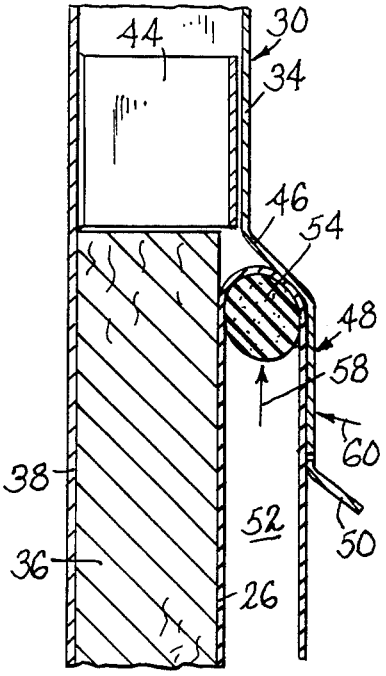
FIG. 4 is a partial cross sectional view along the same lines as FIG. 2 showing the sealing system prior to bending of the tabs.

FIG. 4 illustrates the steps involved in installation of the sealing system and the use of the tabs. After the filler material 54 is pushed up into the filler channel 52 as indicated by arrow 58, the tabs 56 are bent into the filler channel in the direction indicated by arrow 60 thereby closing off the bottom of the filler channel 52 and securely retaining the filler material 54 and the membrane roofing material 26 in position.

Figure 5:
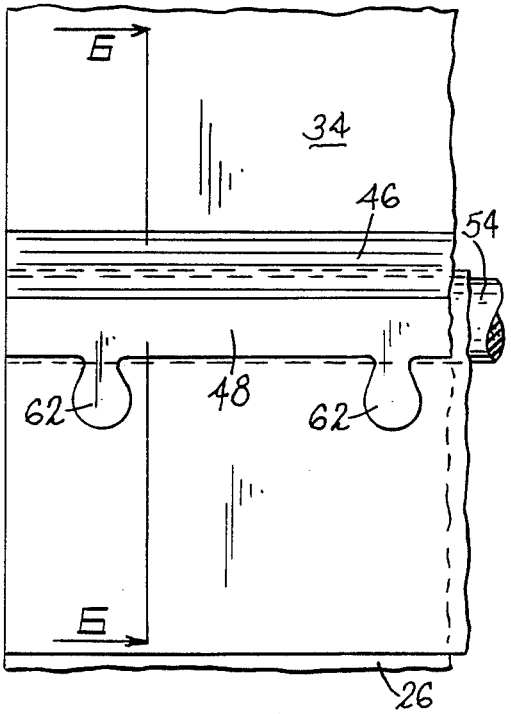
FIG. 5 is a front elevational view of a section of an alternative embodiment of the invention employing spatulate-shaped tabs.
Figure 6:
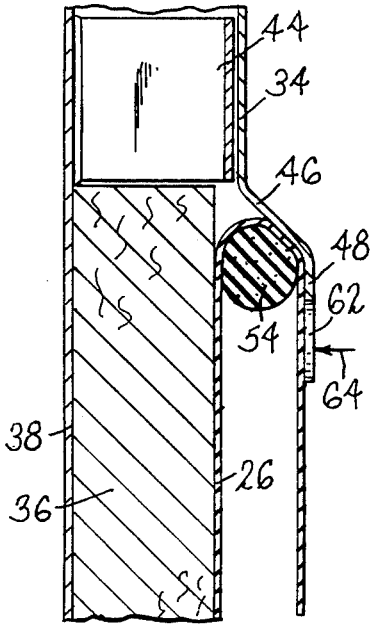
FIG. 6 is a cross sectional view along the line 6—6 of FIG. 5 showing the alternative embodiment prior to bending of the spatulate-shaped tabs of FIG. 5.
Figure 7:
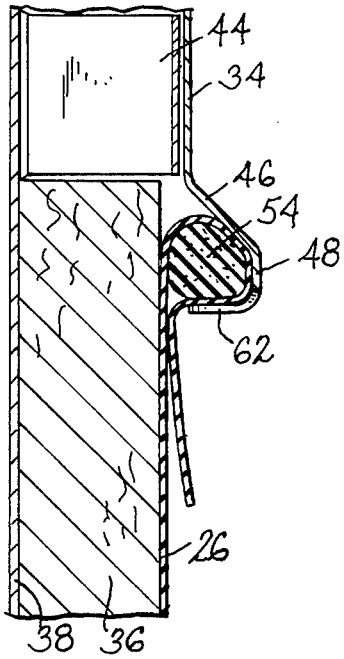
FIG. 7 is a cross sectional view along the same line as FIG. 6 showing the alternative embodiment after the tabs have been bent during installation of the sealing system.

Referring now to FIGS. 5–7, an alternative embodiment of the invention is shown in which spatulate-shaped tabs 62 are provided spaced along the lower edge of the wall flange 48. The portion of the tab connected to the wall flange 48 defines the bending portion of the tab. The width of the bending portion and the thickness of the sheet stock may be selected during manufacture to control the amount of force required to bend the tab which is initially in the position shown in FIG. 6. The tab is bent in the direction shown by arrow 64 either by merely pushing the tab if the bending force is relatively light or by hammering the tab if the bending force is set to a high level. After bending, the tabs reach the position shown in FIG. 7 which prevents the escape of the membrane material from the filler channel.

Because the spatulate-shaped tabs are at their narrowest at the point where they connect to the edge of the wall flange, they preferentially bend at this point when the bending force is applied.

The cap flashing 30 and attached flanges 46, 48, 50 are preferably produced by bending from sheet stock although they may be formed by extrusion. In either case, this produces straight sections of the sealing system which must be assembled into a frame to surround the roof opening to be sealed. These longitudinal sections of the sealing system may be mitered in the field and attached to a conventional curb frame of wood or metal. However, it is preferable for the mitering and assembling to be performed in a factory where the corner joints may be welded and sealed. The sealing system can then be manufactured in standard sizes suitable for positioning on a conventional curb.

In this latter case, the pre-manufactured sealing system may be provided with a matching hatchway cover which is hinged to the sealing system for movement between an open and a closed position as shown in FIG. 1.

In the most highly preferred embodiment, such a hatchway is not only provided with the cover and the matching sealing system, but also the curb 20 and the base flashing 40 are integrated therewith as shown in FIGS. 1 and 2. In this latter embodiment, significant savings are achieved in labor because the system is substantially completely assembled and ready for installation around an existing opening in a roof. The base flashing merely needs to be nailed or screwed to the roof or to the perimeter of the roof opening, and the membrane roof attached as previously described.

It will thus be seen that the objects set forth above, and others made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What I claim is:

1. A sealing system for sealing between a roofing membrane and a curb around a roof opening comprising:

a cap flashing for the curb;

a top flange connected to the cap flashing and extending outwardly therefrom;

a wall flange connected to the top flange and extending downwardly therefrom whereby a filler channel is defined by the top flange, the wall flange and the curb;

a longitudinal resilient filler material sized to fit closely within the filler channel and to hold the roofing membrane; and a plurality of spaced-apart tabs integral with the wall flange, the tabs being inwardly bendable towards the curb whereby the filler and roofing membrane may be securely retained within the filler channel.

2. A sealing system according to claim 1 wherein the cap flashing, top flange, wall flange and tabs are all integrally formed from a single sheet of metal.

3. A sealing system according to claim 1 further including a drip edge flange extending outwardly from the wall flange.

4. A sealing system according to claim 1 wherein the tabs are punched from the wall flange along a substantial portion of their perimeter, the remainder of the unpunched perimeter defining a bending portion of the tab and wherein the force required to bend the tabs is controlled by the width and thickness of the unpunched bending portion.

5. A sealing system according to claim 4 wherein the tabs are shaped as elongated fingers.

6. A sealing system according to claim 1 wherein the tabs extend from a lower edge of the wall flange, the portion of the tab connected to the wall flange defining a bending portion of the tab and wherein the force required to bend the tabs is controlled by the width and thickness of the bending portion.

7. A sealing system according to claim 6 wherein the tabs are spatulate-shaped, the width and thickness of the bending portion being less than the width and thickness of the remainder of the tab to preferentially induce bending in the bending portion of the tab when a bending force is applied to the tab.

8. A sealing system according to claim 1 wherein the sealing system is pre-manufactured in a suitable size and shape to be positioned on an existing curb surrounding the perimeter of the roof opening.

9. A hatchway for a roof opening comprising:

a pre-manufactured sealing system according to claim 1 of suitable size and shape to be positioned on a curb to completely surround the roof opening; and a hatchway cover hinged to the sealing system for movement between an open and closed position.

10. A hatchway for a roof opening according to claim 9 further including a pre-manufactured curb suitable for mounting on a roof around the roof opening, said curb being of a mating size to the pre-manufactured sealing system.

11. A hatchway for a roof opening according to claim 10 wherein the curb and the sealing system form a factory pre-assembled unit.

12. A hatchway for a roof opening according to claim 10 wherein the pre-manufactured curb includes a horizontally extending base flashing.

13. A hatchway for a roof opening according to claim 10 wherein the pre-manufactured curb comprises an inner surface member and an outer surface member.

14. A hatchway for a roof opening according to claim 13 wherein the outer surface member is formed from a composition board material and the inner surface material is sheet metal.

* * * * *